United States Patent [19]

Reed

[11] Patent Number: 4,882,846

[45] Date of Patent: Nov. 28, 1989

[54] STAIR BUILDING TEMPLATE AND METHOD OF USE

[76] Inventor: Philip Reed, 818 Ida Ave. #4, Solana Beach, Calif. 92075

[21] Appl. No.: 217,633

[22] Filed: Jul. 12, 1988

[51] Int. Cl.[4] ..... B43L 7/00

[52] U.S. Cl. ..... 33/464; 33/427; 33/562

[58] Field of Search ..... 33/456, 464, 452, 427, 33/562, 1 G, 478, 458, 460, 463

[56] References Cited

U.S. PATENT DOCUMENTS

| | | | |
|---|---|---|---|
| 164,008 | 6/1875 | Kirkpatrick | 33/427 |
| 1,015,773 | 1/1912 | Auger | 33/456 |
| 1,183,977 | 5/1916 | Hoefle | 33/464 |
| 2,438,667 | 3/1948 | Hogue | 33/DIG. 9 X |
| 3,153,859 | 10/1964 | Jones . | |
| 3,242,580 | 3/1966 | Crawford . | |

FOREIGN PATENT DOCUMENTS

| | | | |
|---|---|---|---|
| 127330 | 3/1932 | Austria | 33/427 |
| 15619 | 9/1956 | Fed. Rep. of Germany | 33/464 |

OTHER PUBLICATIONS

"Adjustable Stair-Tread Template," *Fine Homebuilding,* p. 90, Aug./Sep. 1988.

Bon Tool Co "Adjustable T-Square-Fine Homebuilder", Jun./Jul. 1988 Issue #40 p. 89.

*Primary Examiner*—Harry N. Haroian

*Attorney, Agent, or Firm*—Nydegger & Harshman

[57] ABSTRACT

A stair building template comprises a plurality of rectangular-shaped horizontal members and a plurality of rectangular-shaped vertical members. Connectors are provided which each hold a horizontal member in a right-angled relationship with a vertical member and each vertical and horizontal member is associated with at least one connector. The horizontal and vertical members slide along their mutual connector when the connector is loosened, but are held fixed with respect to each other when the connector is tightened. Manipulation of the connectors permits the framing of the horizontal and vertical members into a configuration with the desired dimensions for the proposed staircase.

3 Claims, 2 Drawing Sheets

STAIR BUILDING TEMPLATE AND METHOD OF USE

FIELD OF THE INVENTION

The present invention pertains to carpenters' tools. More particularly, the present invention pertains to templates which are adjustable to establish a desired configuration in conformance with specific parameters. The present invention is particularly, but not exclusively, useful for accurately fixing the geometrical configuration for the rise and run of the steps in a staircase.

DISCUSSION OF THE PRIOR ART

While the construction of a staircase is very simple in concept, it can become quite complicated in practice. A major complication in such an endeavor arises from the fact each staircase has its own dimensional requirements. Thus, each staircase must be configured to meet the needs of the particular situation. Specifically, precisely dimensioned building materials are required to ensure that all of the staircase steps are uniform and that the staircase begins and ends at the proper landing points. In short, regardless what materials are used in construction, there is a persistent problem which concerns how to dimension a staircase that makes a smooth and even transition from one landing to another.

It will be appreciated that the preparation for construction of a staircase between the floors of a building requires a sequence of precise vertical and horizontal measurements which must exactly establish the desired configuration. The situation is complicated, however, by the fact these measurements must be made with reference to a vertical surface, such as a wall. This can be awkward to accomplish and, because of the nature of the interconnected measurements, cumulative error can result in an incorrectly measured configuration which is both ineffectual and potentially very wasteful.

Although staircase measurements can be made from the blueprints or drawings of the building, it is far better to make on-the-spot measurements. Even so, errors can be made in properly dimensioning the staircase. For example, once measurements have been taken along the wall from landing to landing, they need to be transferred to lumber stock which must then be properly cut into the desired stair step configuration. This cutting, however, cannot be effectively accomplished unless the measurements have been accurately made in the first instance, and then properly transferred to the lumber stock. Where such a transfer is made by written recordation of the necessary measurements, there is always the potential for error.

The present invention recognizes that the traditional methods for dimensioning a staircase by using written calculations and recordations are time consuming and are susceptible to inaccuracies. In order to overcome these problems, the present invention discloses an adjustable template which can be manipulated at the location of the intended staircase to establish its exact desired configuration. In the desired configuration, the template can then be taken to a location where its dimensions are transferred directly to lumber stock for construction of the staircase.

In light of the above, it is an object of the present invention to provide a carpenter's stair building template which is adjustable to accurately dimension the rise and run of each step in a staircase in relationship to the other steps in the staircase. Another object of the present invention is to provide a template which obviates the need for written calculations and recordations when dimensioning a staircase. Still another object of the present invention is to provide a stair building template which can be used to quickly recheck dimensions in the staircase. Yet another object of the present invention is to provide a stair building template which is easy to use, relatively simple to manufacture and commercially cost effective.

SUMMARY OF THE INVENTION

The novel stair building template of the present invention comprises a plurality of substantially rectangular-shaped horizontal members and a plurality of substantially rectangular-shaped vertical members. Each horizontal member is held by a connector in a right-angled relationship with at least one vertical member. The connector, itself, slidingly engages the respective horizontal and vertical members and includes an adjustable bolt which can be loosened to allow the horizontal and vertical members to slide along the connector in directions perpendicular to each other. when tightened, the adjustable bolt fixedly holds the associated horizontal and vertical members against each other in the right-angled relationship. Both the horizontal and vertical members may be provided with scales imprinted along their lengths to precisely establish and set the exact location each member has in its connected relationship with other members.

In its use, the stair building template of the present invention is configured into the desired geometry of the proposed staircase. To do this, a start point is selected at the top of the stair case. A vertical member is positioned with one of its ends over the start point and a connector, which is associated with both the vertical member and a horizontal member, is positioned on the vertical member at a predetermined distance from the start point. The horizontal member is then extended forward a predetermined distance from the vertical member and the connector is tightened to fixedly hold the horizontal member onto the vertical member at a right angle thereto. The forward extended end of the horizontal member is then established as a new start point and the same procedure using a second vertical member and a second horizontal member is repeated. As many repetitions of this procedure using sequential vertical and horizontal members are performed as are necessary to completely establish the desired staircase configuration. The rigid template can then be transferred from the staircase location and used to mark and cut lumber with the precise dimensions required for the staircase.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
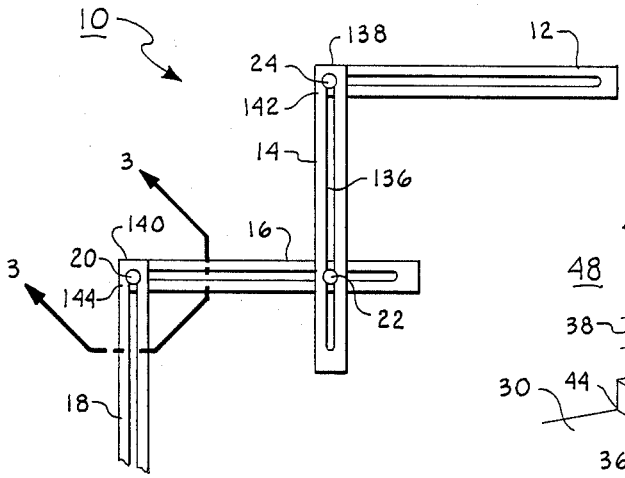
FIG. 1 is a plan view of a portion of the stair building template in an adjusted configuration.

Referring initially to FIG. 1, a stair building template in accordance with the present invention is shown in an adjusted configuration and generally designated 10. As shown in FIG. 1, template 10 comprises a plurality of horizontal members of which horizontal members 12 and 16 are representative. Also, template 10 comprises a plurality of vertical members of which vertical members 14 and 18 are representative. The horizontal and vertical members of template 10 shown in FIG. 1 are held together by a plurality of connectors 20, 22and 24 which are each separately associated with a horizontal member and a vertical member. Specifically, connector 20 is associated with horizontal member 16 and vertical member 18. In a similar manner, connector 22 is associated with horizontal member 16 and vertical member 14. It is to be appreciated that there is only a practical limit to the number of horizontal and vertical members in template 10 and similar connectors are appropriately provided between each horizontal and vertical member. Importantly, each of the connectors 20, 22 and 24 hold their respectively associated horizontal and vertical members in a right-angled relationship. For example, connector 20 provides structure which holds the horizontal member 16 at a right-angled relationship with vertical member 18. Likewise, connector 22 holds horizontal member 16 in a right-angled relationship with vertical member 14. As intended for the present invention, each of the connectors holds its respective horizontal and vertical members in a right-angled relationship. This is so in order to provide an adjustable template 10 which is able to accurately and precisely establish a desired configuration of the stair step arrangement for a staircase.

Figure 2:
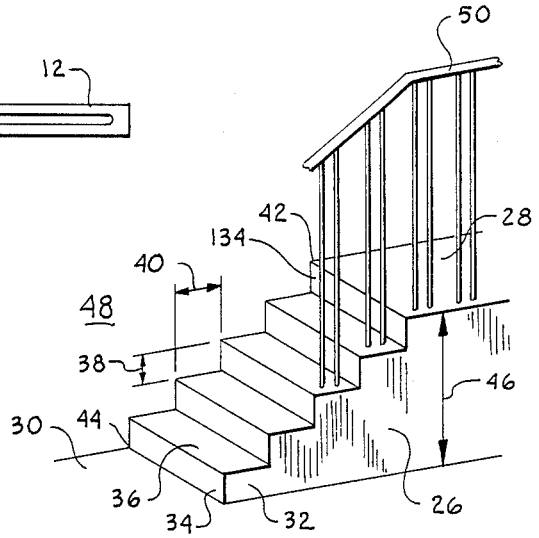
FIG. 2 is a perspective view of a staircase.

FIG. 2 shows a staircase 26 which extends from a landing 28 down to landing 30. As is well known, a staircase transition from landing 28 to landing 30 is accomplished by a series of steps 32 which are each generally defined by a riser 34 and a tread 36. Stated differently, riser 34 is dimensioned as a rise 38 and tread 36 is dimensioned as run 40. Thus, it will be understood that in the transition from landing 28 to landing 30 a sequential variation in the rise 38 and run 40 of each step 32 is to be accomplished in a manner which provides uniformity between a start point 42 on landing 28 and an end point 44 on landing 30. Importantly, this transition is to be accomplished through a height 46 equal to the vertical elevational difference between landing 28 and landing 30. While the configuration of each step is determined with safety configurations in mind, other safety features of staircase 26 are provided either by wall 48 or a bannister 50 or a combination of the two. The actual construction of template 10 will perhaps be best understood by reference to FIG. 3.

Figure 3:
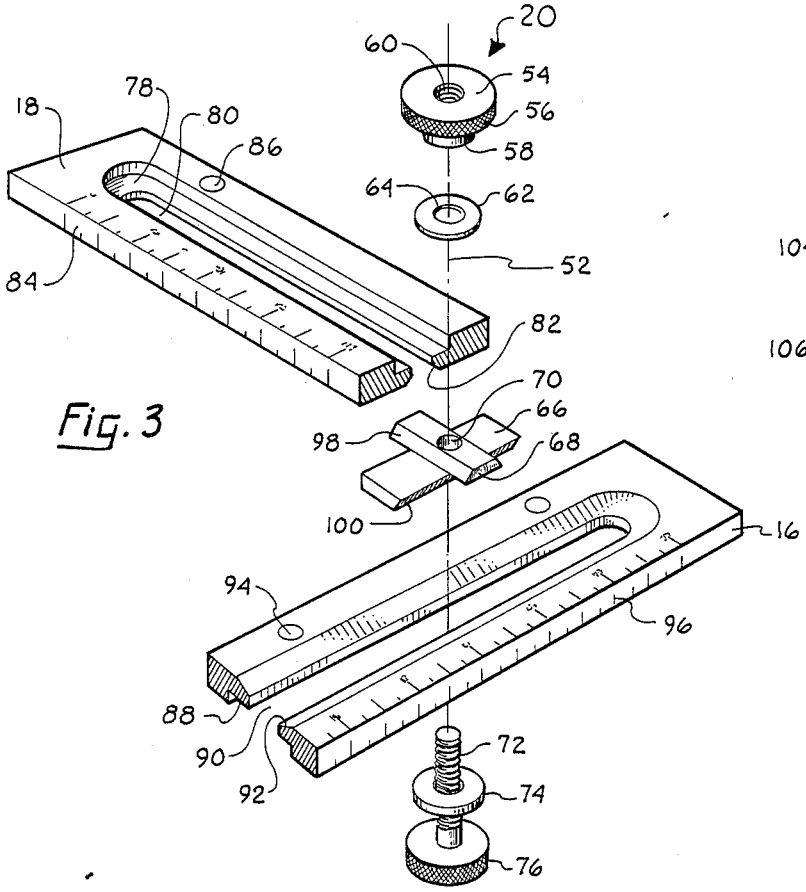
FIG. 3 is an exploded cross-sectional view of the stair building template as seen along the line 3—3 in FIG. 1.

In FIG. 3, a portion of template 10 is shown in an exploded configuration. Specifically, in FIG. 3, it can be seen that horizontal member 16 is positioned at substantially a right angle to vertical member 18 and that connector 20 comprises various elements which are aligned along a common axis 52. As shown sequentially along the axis 52, connector 20 comprises a nut 54 which has a knurled surface 56 and an extension 58. The knurled surface 56 is provided for ease in rotating nut 54 and the extension 58 is provided to serve as a guide for moving nut 54 along vertical member 18 in a manner to be subsequently appreciated. As shown in FIG. 3, nut 54 has a threaded bore 60. A washer 62 having a hole 64 is shown disposed relative to nut 54 to fit against extension 58 and thereby facilitate the rotation of nut 54. Connector 20 necessarily comprises structure which will maintain horizontal member 16 and vertical member 18 in a right-angled relationship. For this purpose, connector 20 includes a horizontal arm 66 and a vertical arm 68 which are fixedly attached to each other. Specifically, horizontal arm 66 is attached to vertical arm 68 in any manner well known in the art, such as by gluing or welding or cementing, that establishes a right angle, i.e. a ninety degree (90°) angle, between the two arms. A hole 70 is provided through both horizontal arm 66 and vertical arm 68 to receive a bolt 72 therethrough. The bolt 72 and its associated head 76 may be provided with a washer 74 to facilitate engagement of the bolt 72 with horizontal member 16.

Also shown in FIG. 3 are details of the vertical member 18. Specifically, FIG. 3 shows that vertical member 18 is a substantially rectangular-shaped structure which has a recess 78 formed on its top side. A slot 80 is formed longitudinally within the recess 78 which extends through vertical member 18 from its top side to its bottom side. Opposite recess 78, on the bottom side of vertical member 18, the slot 80 is bordered by a ramp 82. Further, a scale 84 may be imprinted on the edges of vertical member 18 for accurately positioning vertical member 18 relative to horizontal member 16. Vertical member 18 may also be provided with mounting hole 86 which will provide means by which vertical member 18 can be nailed, or otherwise pinned, to a surface such as wall 48.

FIG. 3 also shows that horizontal member 16 is formed with a recess 88 and has a slot 90 which extends partway along the length of the substantially rectangular-shaped horizontal member 16. Opposite the slot 90 from recess 88, FIG. 3 shows that horizontal member 16 is formed with a ramp 92 which borders slot 90. Further, FIG. 3 shows that horizontal member 16 may be provided with mounting holes 94 at locations on its outer edge and may have a scale 96 imprinted along its edges which is useful for establishing an exact and precise position for horizontal member 16 relative to vertical member 18.

From the above, it can be appreciated that horizontal member 16 and vertical member 18 are held together by connector 20. Specifically, with vertical member 18 placed against horizontal member 16, vertical arm 68 of connector 20 will be positioned against ramp 82 of vertical member 18. Similarly, in this configuration, horizontal arm 66 of connector 20 will be positioned against ramp 92 of horizontal member 16. As can be appreciated from reference to FIG. 3, the surface 98 of vertical arm 68 is configured to conform with ramp 82 and surface 100 of horizontal arm 66 is configured for engagement with ramp 92 of horizontal member 16. With horizontal arm 66 engaged against horizontal member 16 and vertical arm 68 engaged against vertical member 18, bolt 72 is sequentially placed through slot 90 of horizontal member 16, through hole 70 and extended further through slot 80 of vertical member 18. Bolt 72 is then passed through hole 64 of washer 62 and into threaded bore 60 of nut 54. With the components of connector 20 assembled as indicated, a rotation of nut 54 can be accomplished to cause nut 54 and head 76 of bolt 72 to draw closer to one another and press respectively against vertical member 18 and horizontal member 16. With this pressure, members 18 and 16 can be fixedly held in a right-angled relationship with respect to each other. On the other hand, a rotation of nut 54 in the opposite direction loosens connector 20 to permit relative motion between horizontal member 16 and vertical member 18.

Figure 4:
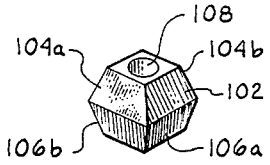
FIG. 4 is an alternate embodiment of the connector for the stair building template shown in FIG. 3.

FIG. 4 shows an alternate structure which can be used with connector 20 in lieu of horizontal arm 66 and vertical arm 68. Specifically, a wedge 102 is shown in FIG. 4 which has a plurality of surfaces. Specifically, surface 104*a* and its opposite surface 104*b* of wedge 102 are oriented with respect to surface 106 of wedge 102 such that when wedge 102 is engaged between horizontal member 16 and vertical member 18, the members 16 and 18 are held in a right-angled relationship. Further, as shown in FIG. 4, wedge 102 is provided with a hole 108 which receives the bolt 72 in a manner similar to that previously discussed for the hole 70 which passes through vertical arm 68 and horizontal arm 66. More specifically, when wedge 102 is incorporated with horizontal member 16 and vertical member 18 into the structure of template 10, the surface 104*a* and the surface 104*b* which is diametrically opposed to surface 104*a* across hole 108 will urge against locations on the ramp 82 which are opposite each other across slot 80. In a similar manner, surface 106*a* and the surface 106*b* diametrically opposed to surface 106*a* across hole 108 will urge against locations on ramp 92 which are opposite each other across slot 90. In all important respects, wedge 102 holds horizontal member 16 relative to vertical member 18 in the same manner as is accomplished by the combination of horizontal arm 66 and vertical arm 68.

Figure 5:
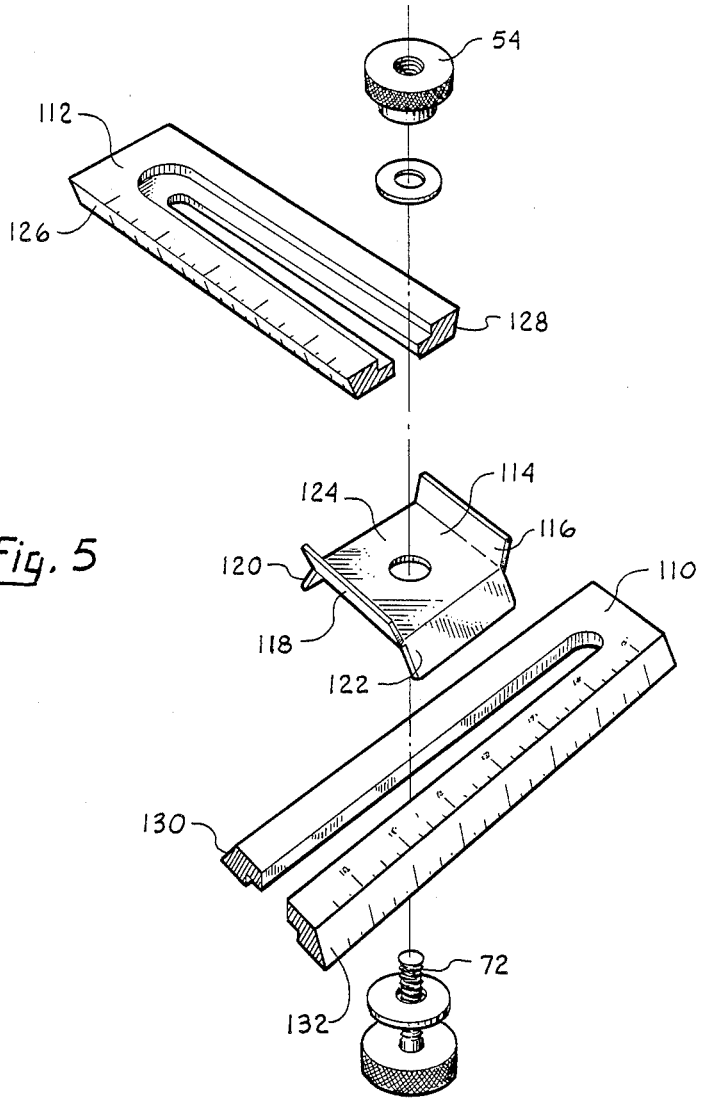
FIG. 5 is an exploded cross-sectional view of an alternate embodiment of the stair building template as would be seen along a line 3—3 as indicated in FIG. 1.

FIG. 5 shows yet another embodiment of a connector for template 10 which also requires some modification of the cooperative components. Specifically, in FIG. 5 it will be seen that template 10 comprises a horizontal member 110 and a vertical member 112 which are held together by a connector that has a base plate 114. Incorporated into this connector are sides 116 and 118 which extend upwardly from base plate 114. Importantly, sides 116 and 118 are oppositely opposed to each other and are configured to engage respectively with inclined edges 128 and 126 of vertical member 112. Base plate 114 is also provided with sides 120 and 122 which extend downwardly from base plate 114 and are configured for engagement respectively with inclined edge 130 and inclined edge 132 of horizontal member 110. As intended by the present invention, bolt 72 extends through horizontal member 110 and through the hole 124 formed in the center of base plate 114. Bolt 72 then extends on through vertical member 112 and into a threaded engagement with nut 54 in a manner similar to that disclosed for the preferred embodiment of template 10. More specifically, relative to base plate 114, the upwardly extending sides 116 and 118 are diametrically opposed to each other across hole 124 and the downwardly extending sides 120 and 122 are diametrically opposed to each other across hole 124.

It will be appreciated by the skilled artisan that for the particular structure shown in FIG. 5, horizontal member 110 will be held in a right-angled relationship with vertical member 112 when nut 54 is manipulated to tighten the connector. On the other hand, bolt 54 can be loosened to allow relative movement between horizontal member 110 and vertical member 112 while still maintaining horizontal member 110 and vertical member 112 in a right-angled relationship.

Figure 6:
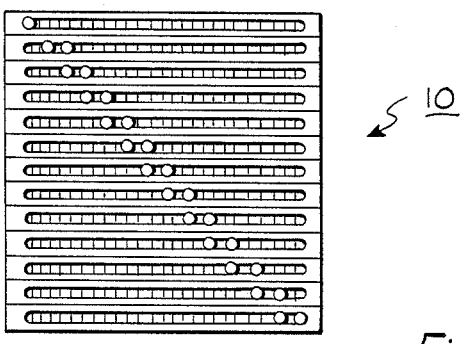
FIG. 6 is a plan view of the stair building template in a folded configuration suitable for storage or transport.

In FIG. 6, template 10 of the present invention is shown in a folded configuration. Specifically, it can be appreciated from reference to FIG. 6 that the various connectors can be loosened and retightened to position each of the horizontal members in a side-by-side relationship. Although not shown in FIG. 6, when the horizontal members are so positioned, the vertical members will likewise be positioned in a side-by-side relationship. The resultant configuration of template 10 is one which is easily stored and relatively easily transported.

OPERATION

In its operation, template 10 is used to accurately and precisely establish the rise 38 and run 40 for each step of staircase 26 in accordance with the desires of the operator. To do this, a start point 42 is identified on the upper landing 28 of staircase 26 and an endpoint 44 is identified on the lower landing 30. Depending on the desired height 46 of staircase 26, and the rise 38 and run 40 for each step between start point 42 and end point 44, a geometrical configuraion for staircase 28 is established.

Although a wide variety of staircase configurations are possible, for present purposes the operation of template 10 will be described as though staircase 26 is to be constructed against wall 48. While it will be understood that when configuring template 10 for staircase 26 it is equally possible to start with a vertical member, the process described here will begin with a horizontal member. To do this, both FIG. 1 and FIG. 2 must be considered. Thus, for the desired configuration of staircase 26, horizontal member 12 is first placed against wall 48 and leveled in a manner well known in the art. It is important to insure horizontal member 12 is, in fact, horizontal. Horizontal member 12 may then be nailed or pinned to wall 46 in order to maintain its position. With horizontal member 12 in place, the forward end 138 of horizontal member 12, i.e. the end of horizontal member 12 which establishes the point where riser 134 drops to the next lower step, is designated the start point 42. Vertical member 14 is then positioned with its upper end 142 over start point 42 and connector 24 is tightened to fixedly hold vertical member 14 in a right-angled relationship with horizontal member 12.

Connector 22, which engages vertical member 14 to horizontal member 16, is loosened and moved downwardly along slot 136 until horizontal member 16 is accurately positioned on vertical member 14 below start point 42 at a distance equal to the preselected dimension for riser 38. Before connector 22 is tightened, however, horizontal member 16 is moved until its forward end 140 is extended from vertical member 14 a distance equal to the preselected dimension for run 40. Scales imprinted on the respective vertical and horizontal members are useful for this purpose. Connector 22 is then tightened to fixedly hold horizontal member 16 at a right-angled relationship to vertical member 14. As with horizontal member 12, horizontal member 16 may be nailed on pinned to wall 46 in order to provide additional stability for template 10.

Connector 20, which engages horizontal member 16 with vertical member 18, is next moved to the forward end 140 of horizontal member 16 and the upper end 144 of vertical member 18 is juxtaposed with forward end 140 of horizontal member 16. Connector 22 is then tightened to fixedly hold the members 16 and 18 in a right-angled relationship. At this time, connector 22 is designated as a new start point and the procedure is repeated as necessary to fully configure template 10 into the desired shape for staircase 26.

It will be appreciated by the skilled artisan that while the above-described procedure configures template 10 while template 10 is placed directly against wall 46, template 10 can also be configured on a flat surface such as a floor. Indeed, it is contemplated that template 10 can be configured first and then subsequently placed against wall 48 to check its accuracy. This, of course, may be done as many times as are necessary to correct any measurement errors before the configuration is transferred to the construction materials. Cutting the construction material into the desired configuration can then be accomplished with a high level of confidence that the end product is accurate.

While the particular stair building template as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A stair template which comprises:

a plurality of horizontal members;

a plurality of vertical members; and a connector, slidably engaged with a horizontal member and a vertical member and adjustable to hold said respective horizontal member in a right-angled relationship with said vertical member, said connector comprising a base plate, a pair of opposed sides upwardly extending from said base plate to receive one of said horizontal members therebetween, and a pair of opposed sides downwardly extending from said base plate to receive one of said vertical members therebetween.

2. A stair template as recited in claim 1 wherein said horizontal members and said vertical members each have longitudinal slots formed therealong.

3. A stair template as recited in claim 2 further comprising an adjustable bolt for holding said horizontal member and said vertical member onto said connector, said bolt being adjustable to loosen said connector from said vertical member and said horizontal member and allow relative motion therebetween.

* * * * *